US008253310B1

(12) United States Patent
Xia

(10) Patent No.: US 8,253,310 B1
(45) Date of Patent: Aug. 28, 2012

(54) LIGHT EMITTING DIODE LIGHT FIXTURE

(75) Inventor: Ben-Fan Xia, KunShan (CN)

(73) Assignees: Furui Precise Component (Kunshan) Co., Ltd., KunShan, Jiangsu Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/207,343

(22) Filed: Aug. 10, 2011

(51) Int. Cl.
*H01J 1/02* (2006.01)

(52) U.S. Cl. ..... 313/46; 362/297

(58) Field of Classification Search ..... 313/46; 362/297, 249.02, 373, 650
See application file for complete search history.

(56) References Cited

U.S. PATENT DOCUMENTS

2009/0279314 A1* 11/2009 Wu et al. ..... 362/373
2009/0296402 A1* 12/2009 Chang et al. ..... 362/294
2010/0126697 A1* 5/2010 Huang ..... 165/80.3
2010/0237760 A1* 9/2010 Yang ..... 313/46

* cited by examiner

*Primary Examiner* — Anne Hines
(74) *Attorney, Agent, or Firm* — Altis Law Group, Inc.

(57) ABSTRACT

An exemplary light fixture includes a holder, an envelope and a lamp body. The lamp body includes a heat dissipation portion, a light source and a shield. The heat dissipation portion has top and bottom ends connecting to the holder and the envelope, respectively. The light source is mounted on the bottom end of the heat dissipation portion and covered by the envelope. The heat dissipation portion includes a plurality of fins extending from the top end to the bottom end of the heat dissipation portion. A passage is defined between every two adjacent fins. The shield surrounds the fins and defines a plurality of windows therein, communicating with the passages.

13 Claims, 7 Drawing Sheets

LIGHT EMITTING DIODE LIGHT FIXTURE

BACKGROUND

1. Technical Field

The present disclosure relates generally to light fixtures, and more particularly to a light fixture for use with solid state light emitters, e.g., light emitting diodes (LEDs).

2. Description of Related Art

LEDs as a source of illumination provide advantages such as resistance to shock and nearly limitless lifetime under specific conditions. Thus, light fixtures utilizing LEDs present a cost-effective yet high quality replacement for incandescent and fluorescent lamps.

A lot of heat is generated during the work of an LED light fixture, which, if not adequately addressed, impacts the reliability of the LED light fixture. A typical way of providing an LED light fixture with good heat dissipation capability is increasing the numbers of fins in the LED light fixture. However, the increase of the fins requires the fins to be extremely thin. The extremely thin fins are easy to deform or even break, which not only impairs the heat dissipation capability of the light fixture, but also destroys the aesthetics of the light fixture. In addition, the extremely thin fins are so sharp that they are dangerous to the users during the installation or replacement of the LED light fixture.

What is needed therefore is an LED light fixture which can overcome the above limitations.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the views.

DETAILED DESCRIPTION

Figure 1:
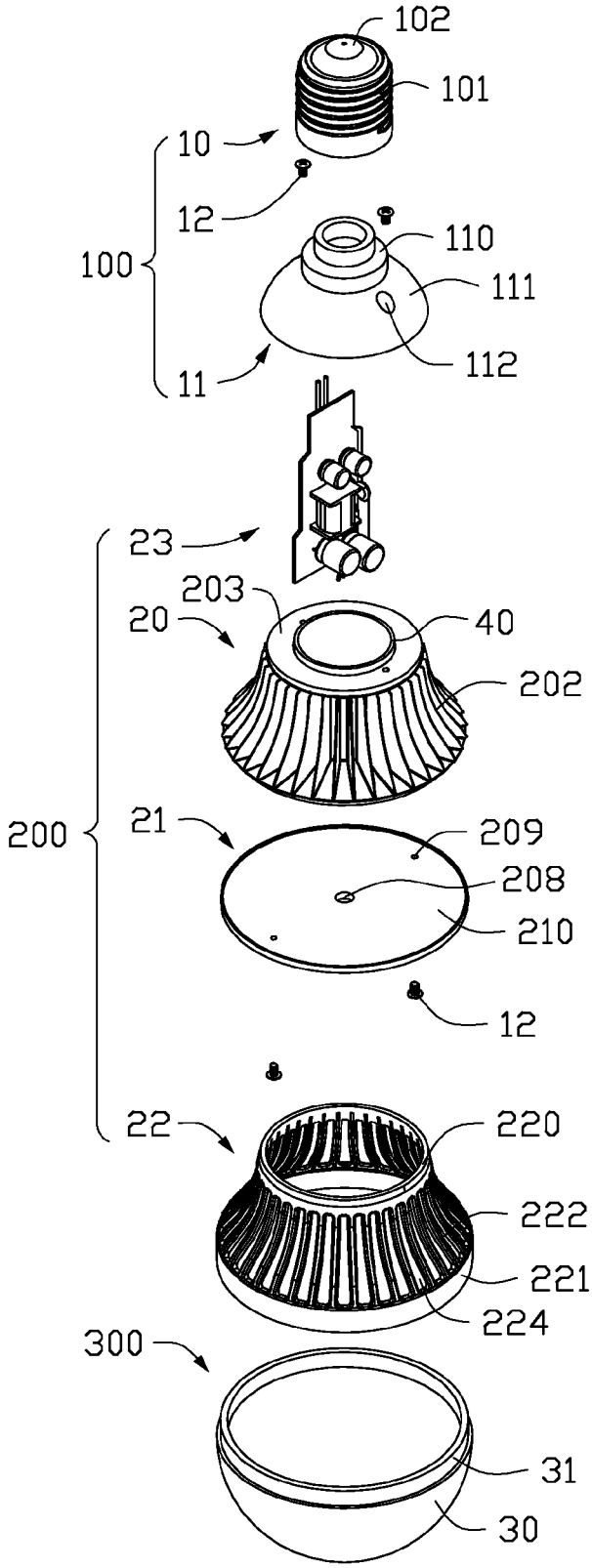
FIG. 1 is an isometric, exploded assembled view of an LED light fixture in accordance with an embodiment of the present disclosure.
Figure 2:
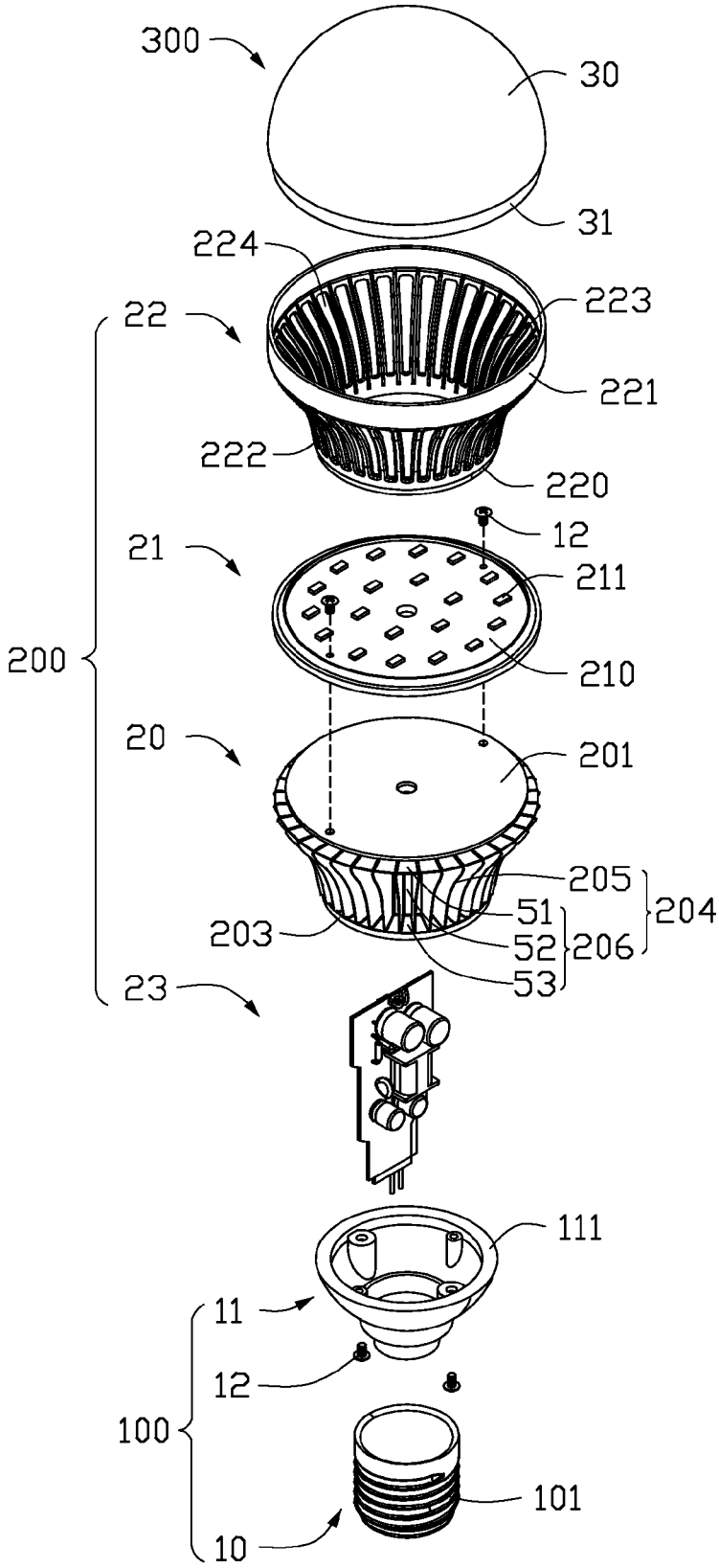
FIG. 2 is similar to FIG. 1, but viewed from a different aspect.
Figure 4:
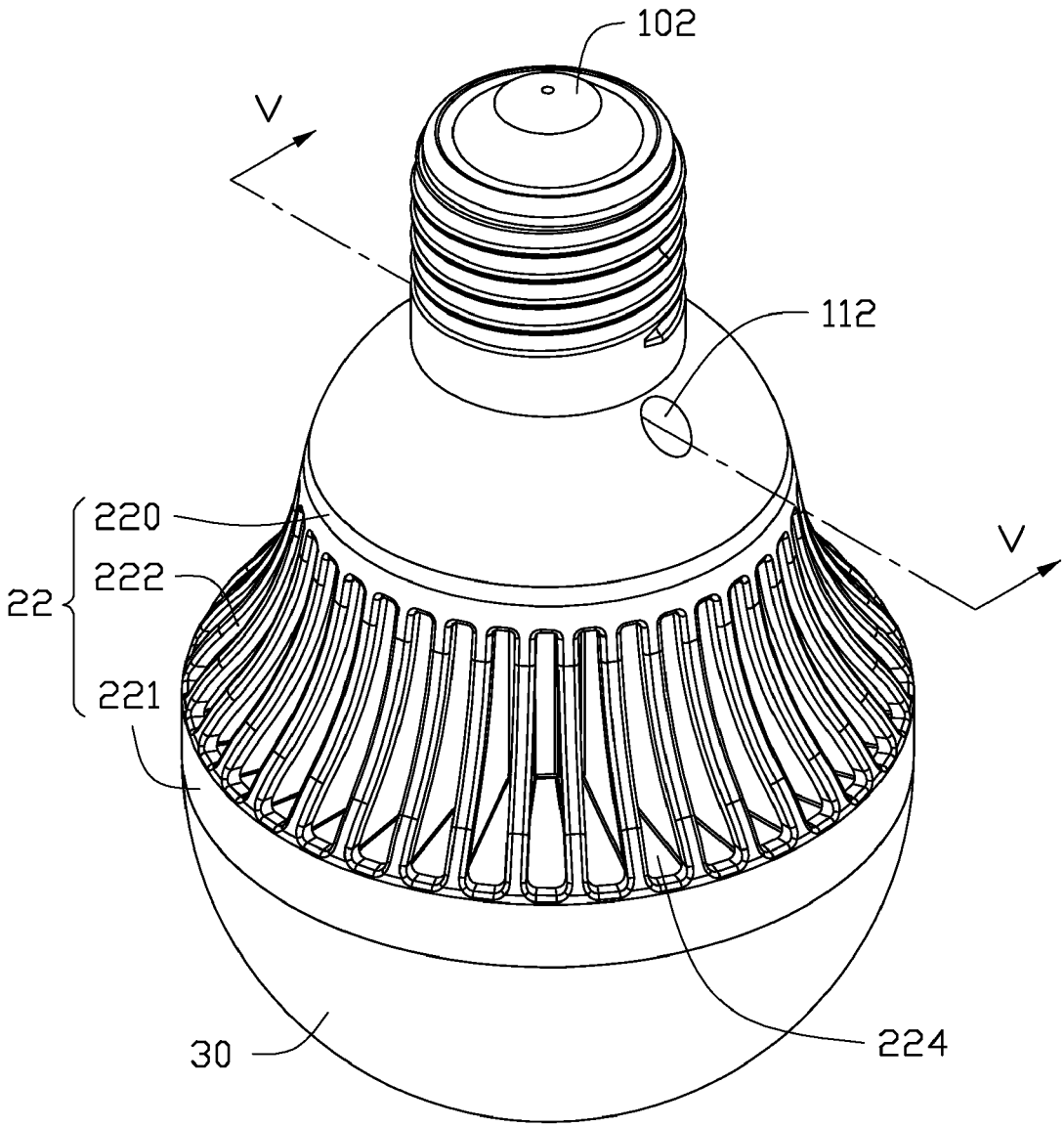
FIG. 4 is an isometric, assembled view of the LED light fixture in FIG. 1.

Referring to FIGS. 1, 2 and 4, an LED light fixture in accordance with an embodiment of the present disclosure comprises a holder 100 for connecting with a power source (not shown), an envelope 300, and a lamp body 200 with a top end connecting with the holder 100 and a bottom end connecting with the envelope 300.

The holder 100 comprises a conducting portion 10 and a connecting portion 11 extending downwardly from the conducting portion 10. The conducting portion 10 has a columned shape. Threads 101 are formed on an outer surface of the conducting portion 10. A conducting pad 102 is formed on a top end of the conducting portion 10. The conducting portion 10 is configured for connecting the power source to provide a power for the LED light fixture. The connecting portion 11 comprises a connecting bar 110 and a connecting bowl 111 extending downwardly from the connecting bar 110. The connecting bar 110 inserts into the conducting portion 10 and engages with the conducting portion 10. The connecting bowl 111 has a substantially spherical contour. Two positioning holes 112 are defined in the connecting bowl 111 for screws 12 extending therethrough to connect the holder 100 and the lamp body 200 together. The connecting portion 11 is made of electrically insulate material such as ceramics.

The lamp body 200 comprises a heat dissipation portion 20, an LED module 21 attached to a bottom of the heat dissipation portion 20 and a shield 22 surrounding the heat dissipation portion 20.

The heat dissipation portion 20 is made of material with good heat conductivity such as aluminum, copper or an alloy thereof. The heat dissipation portion 20 comprises a bottom plate 201, a top plate 203, and a fin unit 202 sandwiched between the bottom and top plates 201, 203.

The bottom plate 201 is round and attached to a bottom end of the fin unit 202. A connecting hole 208 is defined in a center of the bottom plate 201. Two securing holes 209 are defined in the bottom plate 201 and positioned at two sides of the connecting hole 208. The connecting hole 28 is configured for wires (shown in FIG. 5) extending therethrough to electrically connect a power module 23 and the LED module 21. The power module 23 is assembled in the lamp body 200 and the holder 100 to provide control signals and required power for the LED module 21. The securing holes 209 are used to engagingly receive the screws 12 which connect the LED module 21 and the heat dissipation portion 20 together.

The top plate 203 has an annular shape. The top plate 203 is attached to a top end of the fin unit 202. The top plate 203 can be connected to the connecting bowl 111 by the screws 12 extending through the positioning holes 112 of the connecting bowl 111.

Figure 5:
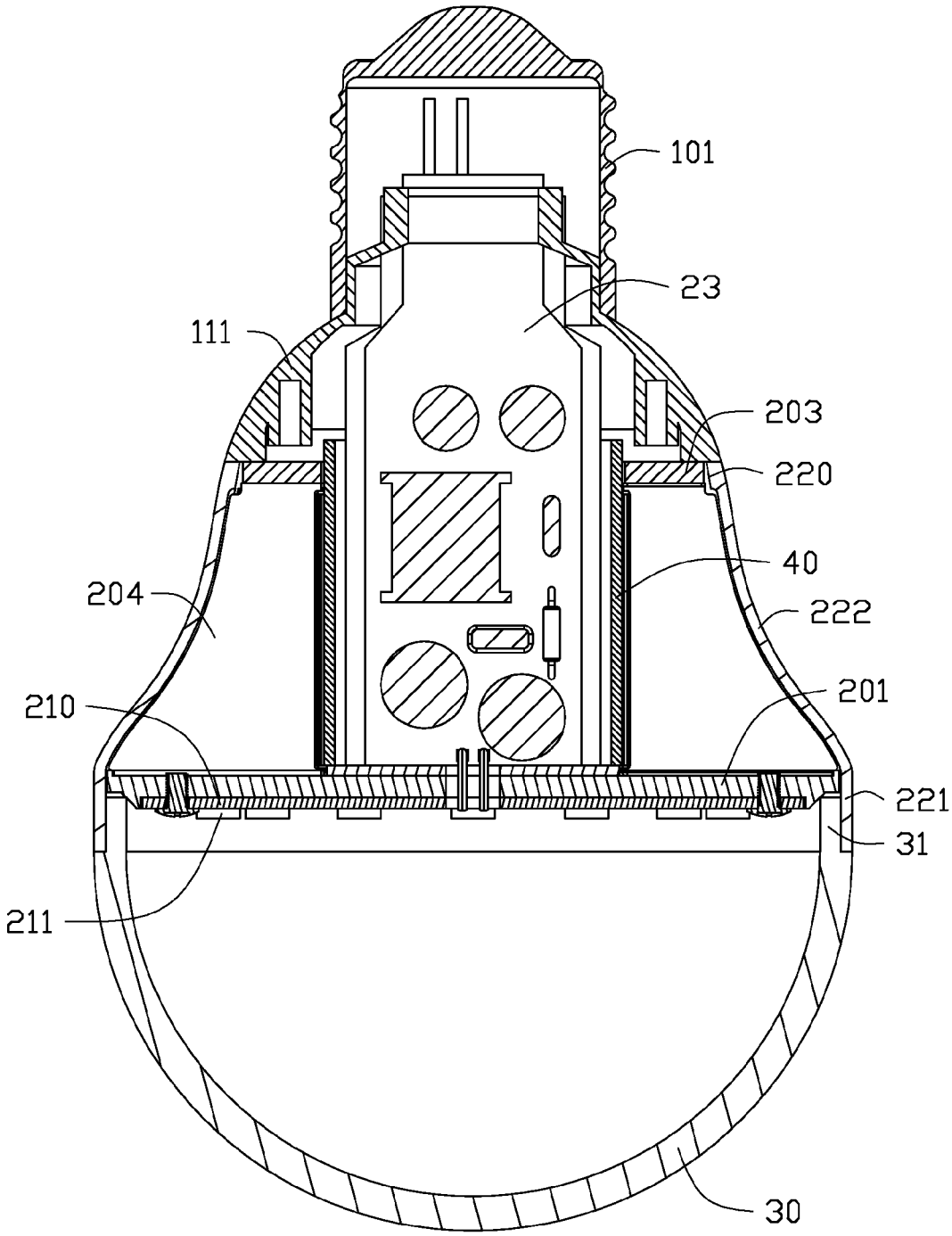
FIG. 5 is a cross sectional view of the LED light fixture, taken along line V-V of FIG. 4.

Also referring to FIG. 5, the fin unit 202 comprises a tube 40 and a plurality of fins 204 surrounding the tube 40. The fins 204 are attached to an outer surface of the tube 40 and extend radially and outwardly from the outer surface of the tube 40. Each fin 204 comprises a main body 205 and a bending portion 206 extending from the main body 205. The main body 205 is vertical to the top and bottom plates 203, 201. The main body 205 has a substantially trapezoid shape. An outer edge of the main body 205 is arced. A passage is defined between two adjacent main bodies 205 for allowing air to flow therethrough. The bending portion 206 comprises a bottom bending plate 51 bending from a bottom edge of the main body 205, a lateral bending plate 52 bending from an inner edge of the main body 205, and a top bending plate 53 bending from a top edge of the main body 205. The bottom, lateral and top bending plates 51, 52, 53 extend from a same side of the main body 205. The bottom bending plate 51 is attached to the bottom plate 201 of the heat dissipation portion 20. The top bending plate 53 is attached to the top plate 203 of the heat dissipation portion 20. The lateral bending plate 52 is attached to the outer surface of the tube 40. The fins 204 also extend from the top plate 203 to the bottom plate 201. The power module 23 inserts in the tube 40 and electrically connects with the LED module 21 and the holder 100. A top end of the tube 40 extends through the top plate 203.

Figure 3:
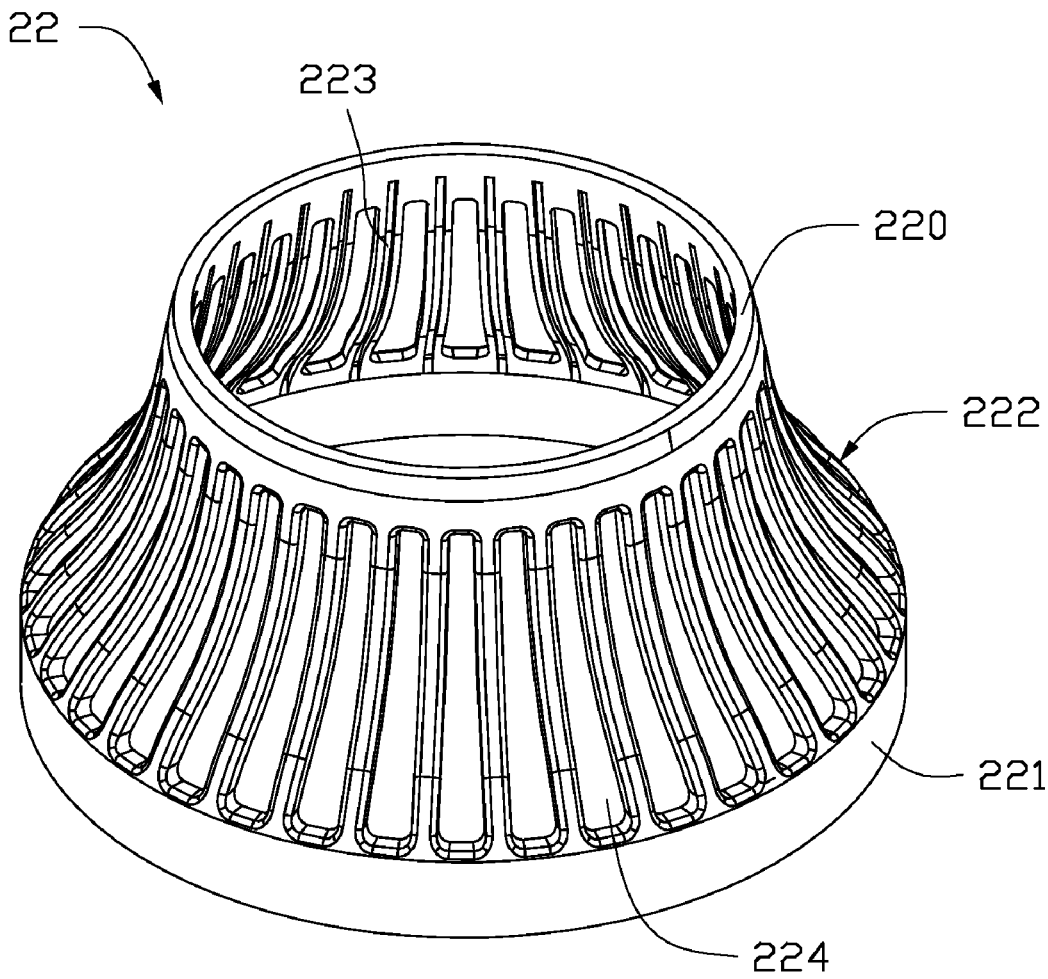
FIG. 3 is an enlarged view of a shield of the LED light fixture in FIG. 1.

Also referring to FIG. 3, the shield 22 can be made of metal or plastic. The shield 22 comprises a first engaging portion 220, a second engaging portion 221 and a protecting portion 222 interconnecting the first and second engaging portions 220, 221. The first engaging portion 220 has an annular shape and engages with a periphery of the top plate 203. The second engaging portion 221 also has an annular shape but is larger than the first engaging portion 220. The second engaging portion 221 engages with a periphery of the bottom plate 201. The second engaging portion 221 also engages with the envelope 300. A plurality of grooves 223 is defined in an inner surface of the protecting portion 222. The grooves 223 extend along an extending direction of the main bodies 205 of the fins 204 and are positioned corresponding to the outer edges of the main bodies 205 respectively. The grooves 223 each have a configuration similar to that of each of the outer edges of the main bodies 205, whereby the grooves 223 fittingly receive the outer edges of the main bodies 205 of the fins 204 therein, respectively. A plurality of windows 224 is defined in the protecting portion 222. The windows 224 extend along the extending direction of the main bodies 205 of the fins 204. Each window 224 is communicated with a corresponding passage between two adjacent fins 204 and positioned between two adjacent grooves 223.

The LED module 21 comprises a circuit board 210 and a plurality of LEDs 211 mounted on the circuit board 210. The circuit board 210 is round. The circuit board 210 is secured on the bottom plate 201 of the heat dissipation portion 20 by screws 12.

The envelope 300 is made of transparent or translucent material such as glass or resin. The envelope 300 comprises a semi-spherical light transmitting portion 30 and an abutting portion 31 extending from an opening of the light transmitting portion 30. The abutting portion 31 is engagingly received in the second engaging portion 221 of the shield 22.

Figure 6:
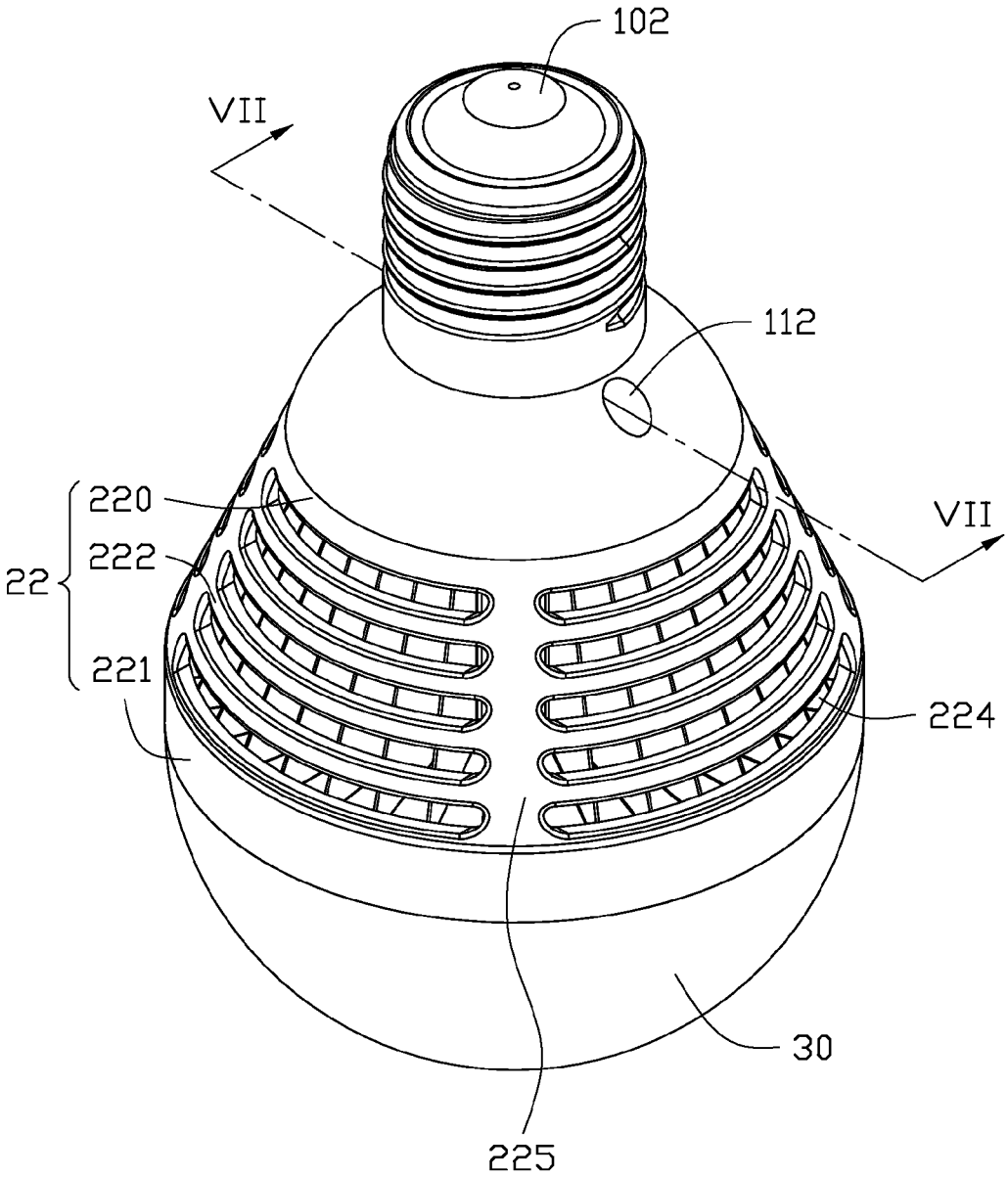
FIG. 6 is an isometric, assembled view of an LED light fixture in accordance with another embodiment of the present disclosure.
Figure 7:
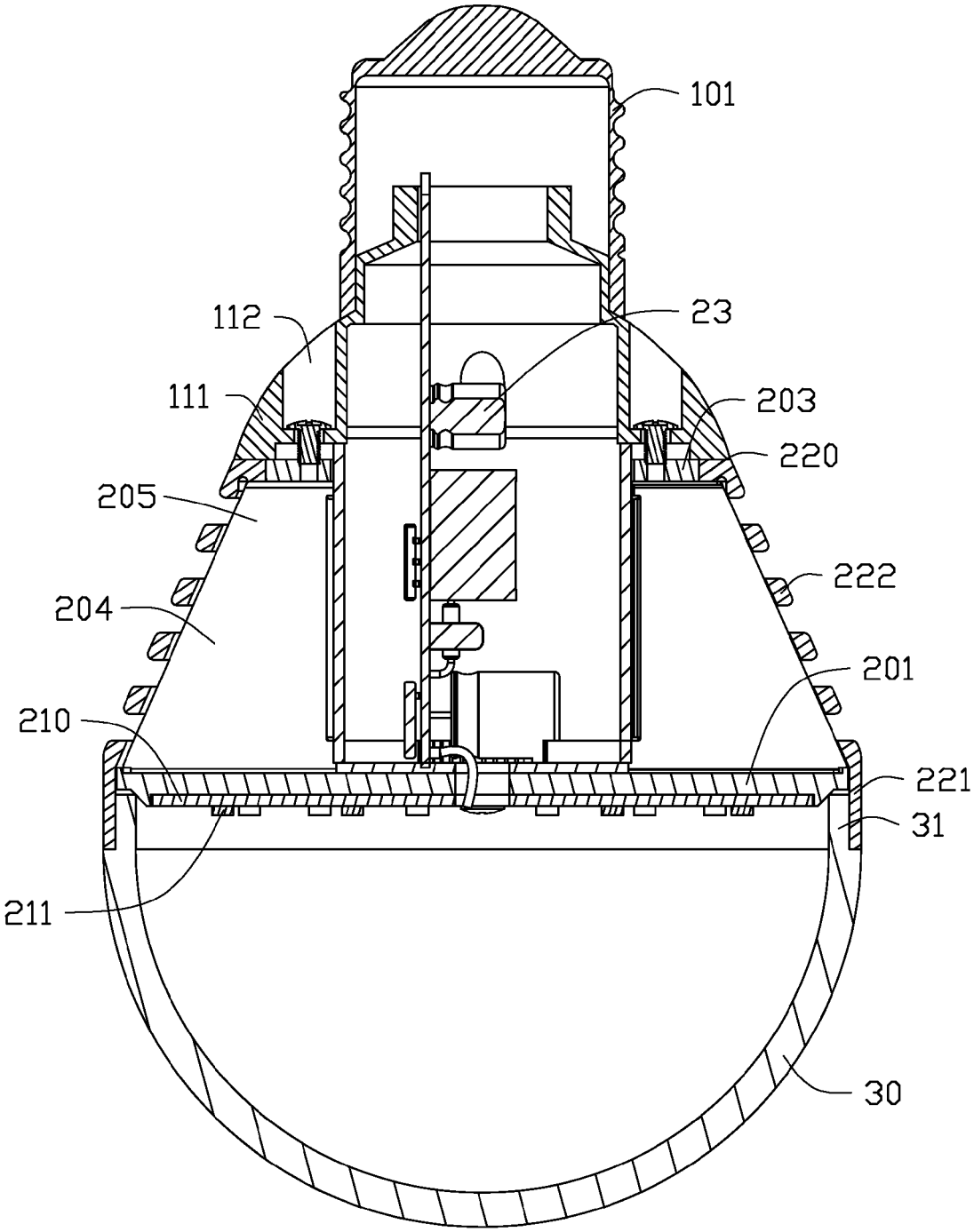
FIG. 7 is a cross sectional view of the LED light fixture, taken along line VII-VII of FIG. 6.

Referring to FIGS. 6 and 7, an LED light fixture in accordance with another embodiment of the present disclosure is shown. The LED light fixture is similar to that in the previous embodiment. One of the differences therebetween is that the main bodies 205 of the fins 204 each have a trapezium shape and outer edges of the main bodies 205 are straight.

Further, another difference is that the windows 224 defined in the protecting portion 222 of the shield 22 extend along a direction perpendicular to the extending direction of the main bodies 205 of the fins 204. The windows 224 are arranged in a matrix with several columns. The top window in each column of the windows 224 has the shortest length. The bottom window in each column of the windows 224 has the longest length. A spacing region 225 is positioned between two adjacent columns of the windows 224.

The holder 100 is preferably a standard holder such that the LED light fixture can replace a traditional incandescent bulb.

The LED light fixture provided in the present disclosure has a shield 22 formed outside of the fins 204. Thus, the fins 204 are not easy to deform or break and will not hurt the user's hand when he (she) grips the LED light fixture for installation or replacement.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A light emitting diode (LED) light fixture comprising:

a holder;

an envelope; and a lamp body comprising a heat dissipation portion, an LED light source and a shield, the heat dissipation portion having top and bottom ends connecting with the holder and the envelope, respectively, the light source being mounted on the bottom end of the heat dissipation portion and covered by the envelope, the heat dissipation portion comprising a plurality of fins extending from the top end to the bottom end of the heat dissipation portion, a passage being defined between every two adjacent fins, the shield surrounding the fins and defined a plurality of windows therein communicating with the passages;

wherein the shield comprises a first engaging portion engaging with the holder and the top end of the heat dissipation portion, a second engaging portion engaging with the envelop and the bottom end of the heat dissipation portion, and a protecting portion interconnecting the first and second engaging portions, the windows being defined in the protecting portion; and wherein an inner surface of the protecting portion defines a plurality of grooves fittingly receiving therein outer edges of the fins, respectively, the grooves being defined between the first and second engaging portions and extending along an extending direction of the fins.

2. The LED light fixture of claim 1, wherein the windows extend along an extending direction of the fins.

3. The LED light fixture of claim 1, wherein the heat dissipation portion further comprises a top plate and a bottom plate sandwiching the fins, the first engaging portion of the shield engaging with a periphery of the top plate, and the second engaging portion of the shield engaging with a periphery of the bottom plate.

4. The LED light fixture of claim 3, wherein the LED light source is an LED module which is mounted on the bottom plate of the heat dissipation portion, the LED module comprising a circuit board and a plurality of LEDs mounted on the circuit board.

5. The LED light fixture of claim 1, wherein the envelope further comprises an abutting portion inserting in the second engaging portion of the shield and engaging with the second engaging portion.

6. The LED light fixture of claim 1, wherein the heat dissipation portion further comprises a tube surrounded by the fins.

7. The LED light fixture of claim 6, further comprising a power module inserting in the tube and the holder, the power module electrically connecting with the LED light source and the holder.

8. An LED light fixture comprising:

a heat dissipation portion comprising a top plate, a bottom plate and a plurality of fins sandwiched between the top and bottom plates, the fins extending from the top plate to the bottom plate and defining a plurality of passages therebetween;

an LED module mounted on the bottom plate; and a shield surrounding the fins, the shield comprising a first engaging portion engaging with the top plate, a second engaging portion engaging with the bottom plate, and a protecting portion interconnecting the first and second engaging portions, an inner surface of the protecting portion between the first and second engaging portions defining a plurality of grooves fittingly receiving therein outer edges of the fins, respectively, and a plurality of windows being defined in the protecting portion and communicating with the passages, the grooves extending along an extending direction of the fins.

9. The LED light fixture of claim 8, wherein the windows extend along an extending direction of the fins.

10. The LED light fixture of claim 8, further comprising an envelope covering the LED module and engaging with the second engaging portion of the shield.

11. The LED light fixture of claim 8, further comprising a power module electrically connecting to the LED module, and wherein the heat dissipation portion further comprises a tube surrounded by the fins and receiving the power module.

12. The LED light fixture of claim 11, wherein each fin comprises a main body, and a top bending plate extending from a top edge of the main body, a bottom bending plate extending from a bottom edge of the main body and a lateral bending plate extending from an inner edge of the main body, the top bending plate attached to the top plate of the heat dissipation portion, the bottom bending plate attached to the bottom plate, the lateral bending plate attached an outer surface of the tube, and an outer edge of the main body being received in a groove defined by the shield.

13. The LED light fixture of claim 8, further comprising a holder adapted for connecting with a power source, the holder having a conducting portion and a connecting portion, the connecting portion connecting with the top plate of the heat dissipation portion.

* * * * *